US009062359B2

(12) United States Patent
Kim

(10) Patent No.: US 9,062,359 B2
(45) Date of Patent: Jun. 23, 2015

(54) HIGH CARBON CHROMIUM BEARING STEEL, AND PREPARATION METHOD THEREOF

(75) Inventor: Kwan-Ho Kim, Pohang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 13/813,963

(22) PCT Filed: Aug. 5, 2011

(86) PCT No.: PCT/KR2011/005745

§ 371 (c)(1),
(2), (4) Date: Feb. 4, 2013

(87) PCT Pub. No.: WO2012/018239

PCT Pub. Date: Feb. 9, 2012

(65) Prior Publication Data

US 2013/0139991 A1 Jun. 6, 2013

(30) Foreign Application Priority Data

Aug. 6, 2010 (KR) ..... 10-2010-0075869

(51) Int. Cl.

| | |
|---|---|
| ***C22C 38/18*** | (2006.01) |
| ***C22C 38/02*** | (2006.01) |
| ***C22C 38/04*** | (2006.01) |
| ***B22D 1/00*** | (2006.01) |
| ***C22C 38/00*** | (2006.01) |
| ***B22D 25/00*** | (2006.01) |

(52) U.S. Cl.

CPC ..... *C22C 38/005* (2013.01); *C22C 38/00* (2013.01); *C22C 38/008* (2013.01); *C22C 38/02* (2013.01); *C22C 38/04* (2013.01); *C22C 38/18* (2013.01); *B22D 25/00* (2013.01)

(58) Field of Classification Search

None

See application file for complete search history.

(56) References Cited

U.S. PATENT DOCUMENTS

| | | | | |
|---|---|---|---|---|
| 3,360,365 | A * | 12/1967 | Eichler | 420/83 |
| 5,705,124 | A | 1/1998 | Ochi et al. | |
| 7,226,493 | B2 | 6/2007 | Grong et al. | |
| 2006/0157162 | A1 | 7/2006 | Hirata et al. | |

(Continued)

FOREIGN PATENT DOCUMENTS

| | | | |
|---|---|---|---|
| CN | 1129465 | A | 8/1996 |
| CN | 1380435 | A | 11/2002 |
| CN | 101490285 | A | 7/2009 |

(Continued)

OTHER PUBLICATIONS

Machine-English translation of Japanese patent No. 07-003398, Jan. 6, 1995, Takagi Massaki et al.*

(Continued)

*Primary Examiner* — Deborah Yee

(74) *Attorney, Agent, or Firm* — The Webb Law Firm

(57) ABSTRACT

Provided is bearing steel having excellent fatigue life by minimizing segregation during casting of the bearing steel and reducing the generation of large carbides in a segregation band. The high-carbon chromium bearing steel includes 0.5 wt % to 1.2 wt % of carbon (C), 0.15 wt % to 2.0 wt % of silicon (Si), 0.05 wt % to 0.45 wt % of manganese (Mn), 0.025 wt % or less (excluding 0 wt %) of phosphorus (P), 0.025 wt % or less (excluding 0 wt %) of sulfur (S), 0.1 wt % to 1.6 wt % of chromium (Cr), 0.01 wt % to 0.3 wt % of Ce, and iron (Fe) as well as other unavoidable impurities as a remainder. A method of manufacturing the steel is also provided.

7 Claims, 6 Drawing Sheets

INVENTIVE EXAMPLE 2

(56) References Cited

U.S. PATENT DOCUMENTS

| | | | | |
|---|---|---|---|---|
| 2009/0211400 | A1 | 8/2009 | Grong et al. | |
| 2013/0305880 | A1* | 11/2013 | Grong et al. | 75/305 |

FOREIGN PATENT DOCUMENTS

| | | | |
|---|---|---|---|
| EP | 0337639 | A1 | 10/1989 |
| GB | 2224725 | A | 5/1990 |
| JP | 55085616 | A | 6/1980 |
| JP | 1092341 | A | 4/1989 |
| JP | 06248302 | A | 9/1994 |
| JP | 07299550 | A | 11/1995 |
| JP | 08132205 | A | 5/1996 |
| JP | 11092869 | A | 4/1999 |
| JP | 11193823 | A | 7/1999 |
| JP | 2004277777 | A | 10/2004 |
| JP | 2006016683 | A | 1/2006 |
| JP | 2009127113 | A | 6/2009 |
| KR | 100501465 | B1 | 7/2005 |

OTHER PUBLICATIONS

English abstract of SU patent No. 899700 B, Samsonov A. N. et al., Jan. 26, 1983.*

* cited by examiner

COMPARATIVE EXAMPLE

INVENTIVE EXAMPLE 2

COMPARATIVE EXAMPLE

INVENTIVE EXAMPLE 2

COMPARATIVE EXAMPLE

INVENTIVE EXAMPLE 2

COMPARATIVE EXAMPLE

INVENTIVE EXAMPLE 2

HIGH CARBON CHROMIUM BEARING STEEL, AND PREPARATION METHOD THEREOF

TECHNICAL FIELD

The present invention relates to bearing steel, and more particularly, to high-carbon chromium bearing steel able to improve fatigue resistance of a bearing material by reducing the occurrence of segregation through the refinement of a segregation band in a casting material and a method of manufacturing the same.

BACKGROUND ART

In general, bearing steel is made in a converter or an electric furnace and then refined in a ladle by allowing a strong reducing atmosphere to be maintained to decrease an amount of non-metallic inclusions therein, and continuously refined in a state in which an oxygen content (T[O]) is decreased up to 12 ppm or less through a vacuum degassing process. Subsequently, the bearing steel is solidified into slabs or steel ingots through a casting process and then rolled into billets after soaking is performed in order to remove segregation and large carbides contained in the material. Thereafter, the bearing steel billets are formed as wires or bars by performing an extremely slow cooling operation in a rolling mill for softening the material. The wires or bars are machined into balls or rollers, rolling elements of the bearing steel, or inner and outer races through spheroidizing annealing and subsequently, quenching and tempering treatments are performed as hardening heat treatments to produce bearings, final products, through a polishing process.

With respect to the bearing steel produced through a casting process as above, it is generally considered that the generation of segregation and large carbides in the material may be unavoidable, due to of high carbon and high chromium contents. That is, since a difference between solubilities of a solute element in a solid phase and a liquid phase exists during solidification, solute atoms may be discharged and accumulated at a forward edge of a solid-liquid interface, and this may subsequently generate microsegregation between dendrites. The microsegregation between dendrites is absorbed into the inside of a solidification shrinkage cavity generated in a center portion of the material at the completion of the solidification to thus cause a large amount of center segregation, and as a result, large carbides may be generated in a center segregation band of the material. These large carbides may become a cause of a premature fatigue fracture initiated in the region of the large carbides during a fatigue test or in actual use to induce a bearing flaking phenomenon. FIG. 1 illustrates large carbides generated in a shrinkage cavity and it may be confirmed that a portion of the shrinkage cavity may not be filled.

A prior art method for removing large carbides in a segregation band of a casting material most adversely affecting mechanical properties of bearing steel may include a method of preventing the absorption of microsegregation into a shrinkage cavity by casting under a low pressure and a method of removing center segregation and large carbides by diffusion through soaking at a high temperature of 1000° C. or more after casting.

Also, numerous attempts to control the occurrence of segregation by facility have been made, for example, a method of reducing segregation in bearing steel by performing a continuous vertical casting operation under a low pressure ranging from 10 mm to 100 mm has been proposed in Japanese Patent Application Laid-Open Publication No. 1996-132205 and a technique of installing a roll in a solidification portion and performing under a low pressure to control segregation has been proposed in Japanese Patent Application Laid-Open Publication No. 1994-248302.

A technique of rolling a slab under a low pressure and removing large carbides by soaking at a temperature ranging from 1150° C. to 1250° C. for 2 hours to 5 hours before blooming has been proposed in Japanese Patent Application Laid-Open Publication No. 1995-299550, a technique of inhibiting large carbides by using steel having a phosphorus (P) concentration ranging from 0.002 wt % to 0.009 wt % and maintaining the steel at a temperature ranging from 1150° C. to 1260° C. for less than 2 hours has been proposed in Japanese Patent Application Laid-Open Publication No. 2006-016683, and a technique related to high-carbon chromium bearing steel, in which large carbides are decreased and diffusion annihilated by maintaining the steel at a high temperature of 1050° C. or more for 1 hour to 4 hours, has been proposed in Japanese Patent Application Laid-Open Publication No. 2009-127113.

However, since it may be impossible to completely prevent the generation of segregation and large carbides by using a current technique of casting under a low pressure, soaking must be undertaken after the casting. In addition, soaking by maintaining a cast material at about 1150° C. or more, a generation temperature of carbides, in order to inhibit the formation of large carbides may not only largely increase energy consumption, but decarburization may also excessively occur in a surface layer of the material. Thus, hot scarfing may be required before billet rolling and as a result, yield may also be decreased.

Therefore, since large carbides in a segregation band of a bearing steel casting material may be generated by the growth of microsegregation between dendrites into segregation, a technique of fundamentally addressing the foregoing limitations may be required.

SUMMARY

An aspect of the present invention provides bearing steel having excellent fatigue resistance by reducing the occurrence of segregation and inhibiting the generation of large carbides in a segregation band and a method of manufacturing the same.

According to an aspect of the present invention, there is provided high-carbon chromium bearing steel including: 0.5 wt % to 1.2 wt % of carbon (C); 0.15 wt % to 2.0 wt % of silicon (Si); 0.05 wt % to 0.45 wt % of manganese (Mn); 0.025 wt % or less (excluding 0 wt %) of phosphorus (P); 0.025 wt % or less (excluding 0 wt %) of sulfur (S); 0.1 wt % to 1.6 wt % of chromium (Cr); 0.01 wt % to 0.3 wt % of cerium (Ce); and iron (Fe) as well as other unavoidable impurities as a remainder.

According to another aspect of the present invention, there is provided a method of manufacturing high-carbon chromium bearing steel by casting after refining molten iron including using a cerium (Ce) compound as an inoculant to manufacture the bearing steel.

According to the present invention, bearing steel, in which the addition of manganese (Mn) may be decreased, a degree of higher economic efficiency may be achieved as separate soaking may not be required, the occurrence of segregation may be reduced by promoting the refinement of equiaxed grains in a segregation band, and excellent fatigue life may be obtained by significantly reducing the size of large carbides, may be provided instead of typical bearing steel.

DESCRIPTION OF DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
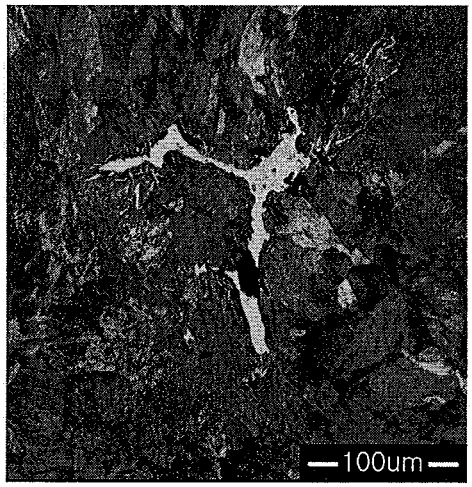
FIG. 1 is a micrograph illustrating a microstructure of large carbides formed in a shrinkage cavity.

Hereinafter, the present invention will be described in detail.

The present inventors recognized the fact that a method of forming a large number of fine equiaxed grains in a segregation band, in which segregation may occur during casting, is effective as a means of obtaining bearing steel having excellent fatigue resistance by minimizing segregation during casting of the bearing steel and reducing the generation of large carbides in the segregation band, thereby leading to completion of the present invention.

In the present invention, a segregation band denotes a portion, in which segregation may occur in a casting material due to casting, and the segregation band may be different according to a type of casting and to a process, even in the same type of casting. For example, a segregation band may be formed in a top portion of an ingot during the casting of the ingot and a segregation band may be formed in a central portion of a casting material during continuous casting.

The present inventors have devised a way of using an inoculant in order to form a large number of fine equiaxed grains in cast bearing steel. The inoculant promotes non-uniform nucleation, in which a specific component in the inoculant may rapidly form compounds or precipitates having a low lattice misfit with a solidification phase, these compounds or precipitates may minimize an increase in interfacial energy of a solid-liquid interface to promote non-uniform nucleation, and as a result, the formation of fine equiaxed grains may be promoted.

Compounds or precipitates having a low lattice misfit with austenites are required as the inoculant, and $AlCeO_3$, $CeO_2$, $Ce_2O_3$, $Ce_2O_2S$, CeS, $Ce_2S_3$, TiC, TiN, $TiO_2$, or $Al_2O_3$ may be used as the inoculant. Preferred examples of the inoculant may be $CeO_2$ and $Ce_2O_3$. Since a lattice misfit of $CeO_2$ with austenites is 6.7% whereas a lattice misfit of $Ce_2O_3$ with austenites is 11.0%, $CeO_2$, for example, may be used as an inoculant for promoting the formation of fine equiaxed grains during the casting of bearing steel.

Hereinafter, compositions of the bearing steel of the present invention will be described in detail, in terms of weight percentage, (hereinafter, wt %).

Carbon (C): 0.5 wt % to 1.2 wt %

Carbon is very important element for securing the strength of bearing steel. In the case that a content of carbon is low, since the bearing steel may not be suitable for parts of a bearing due to causing low strength and low fatigue resistance in the bearing, the content of carbon added may be more than 0.5 wt % or more. In contrast, in the case in which the content of carbon is relatively high, since undissolved large carbides remain, fatigue strength may not only be decreased, but processability before quenching may also be deteriorated. Therefore, an upper limit thereof may be 1.2 wt %.

Silicon (Si): 0.15 wt % to 2.0 wt %

Silicon is an element affecting hardenability, and since limitations in hardenability may occur in the case that a content of silicon is relatively low, the content thereof may be 0.15 wt % or more. However, in the case that the content of silicon is relatively high, since decarburization may occur due to site competition with carbon and processability before quenching may not only be deteriorated as in the case of carbon but segregation may also be increased, an upper limit thereof may be 2.0 wt %.

Manganese (Mn): 0.05 wt % to 0.45 wt %

Manganese is an important element for securing strength by improving hardenability of steel and a content thereof may be 0.05 wt % or more. However, in the case in which the content of manganese is relatively high, since processability before quenching may not only be deteriorated, but precipitation of MnS adversely affecting segregation and fatigue life may also be increased, the content thereof may be 0.45 wt % or less.

Phosphorus (P): 0.025 wt % or less (excluding 0)

Phosphorus is an element that reduces steel toughness due to segregation at grain boundaries. Thus, a content thereof may be actively limited. Therefore, in consideration of a load such as a steel making process, the content thereof may be limited to 0.025 wt % or less.

Sulfur (S): 0.025 wt % or less (excluding 0)

Sulfur acts to increase machinability. However, since sulfur may not only reduce toughness due to the segregation at grain boundaries as in the case of phosphorus but may also have an adverse effect in decreasing fatigue resistance through the formation of MnS sulfide by being combined with manganese, a content thereof may be limited. Therefore, the content thereof may be limited to 0.025 wt % or less in consideration of a load such as a steel making process.

Chromium (Cr): 0.1 wt % to 1.6 wt %

Since chromium improves quenchability of steel to provide hardenability and is an effective element for refining a structure of steel, chromium may be added in an amount of 0.1 wt % or more. However, since an effect of chromium may be saturated in the case that a content of chromium is excessive, the content thereof may be 1.6 wt % or less.

Cerium (Ce): 0.01 wt % to 0.3 wt %

Cerium is an effective element that refines a structure of steel by being added to act as an inoculate. However, in the case in which a content of cerium is excessive, stability of a steel making process may be considerably decreased and the formation of oxides may be rapidly performed to thus saturate an effect of promoting the formation of equiaxed grains. Therefore, the content thereof may be 0.3 wt % or less.

In addition to the foregoing compositions, iron (Fe) as well as other unavoidable impurities may be included as a remainder. However, other compositions in addition to the foregoing compositions may also be included.

As described above, Ce may act as an inoculant to promote non-uniform nucleation of austenite grains by forming a Ce compound during the manufacturing of the bearing steel of the present invention. The Ce compound may be Ce oxides, Ce carbides, Ce nitrides, or Ce sulfides, and specifically, may be $AlCeO_3$, $CeO_2$, $Ce_2O_3$, $Ce_2O_2S$, CeS, $Ce_2S_3$, etc. Among these, the Ce compound may be $CeO_2$ and $Ce_2O_3$, and for example, may be $CeO_2$.

A lattice misfit of the Ce compound with a casting structure formed by the casting may be 15% or less. Since the non-uniform nucleation of austenite grains initiated in the Ce compound may be difficult in the case in which the lattice misfit is greater than 15%, the effect of refining equiaxed grains may not be expected. Therefore, the lattice misfit with a casting structure may be 15% or less.

In order for particles of the Ce compound to act as non-uniform nucleation sites of austenite grains, the shape thereof may be spherical and an average diameter thereof may be 20 μm or less. Also, the Ce compound may be uniformly distributed at a number concentration ranging from $5/mm^2$ to $200/mm^2$.

In the case that the average diameter of the Ce compound is greater than 20 μm, an effect of an inoculant as the non-uniform nucleation sites of austenite grains may be insignificant. Also, in the case that the number concentration of the Ce compound is less than $5/mm^2$, the generated equiaxed grains may not be refined but may be coarsened, and in the case in which the number concentration thereof is greater than $200/mm^2$, the effect thereof may be superposed and saturated. Therefore, the number concentration thereof may be $200/mm^2$ or less.

Hereinafter, a method of manufacturing the bearing steel of the present invention will be described in detail.

In the method of manufacturing the bearing steel of the present invention by casting after refining molten iron, a Ce compound is used as an inoculant to manufacture the bearing steel. The Ce compound acts as an inoculant during the manufacturing of the bearing steel to secure grain refinement through the non-uniform nucleation of austenite grains.

In the present invention, a compound containing Ce is added during the refinement of the molten iron to manufacture molten steel including 0.5 wt % to 1.2 wt % of C, 0.15 wt % to 2.0 wt % of Si, 0.05 wt % to 0.45 wt % of Mn, 0.025 wt % or less (excluding 0) of P, 0.025 wt % or less (excluding 0) of S, 0.1 wt % to 1.6 wt % of Cr, 0.01 wt % to 0.3 wt % of Ce, and Fe as well as other unavoidable impurities as a remainder.

The compound containing Ce is different from the Ce compound described as an inoculant. The compound containing Ce may be the Ce compound acting as an inoculant and specifically, may be Ce oxides, Ce carbides, Ce nitrides, or Ce sulfides. The compound containing Ce may even include a material that may form the Ce compound through a reaction by being added during the refinement. The material may have various types and a specific example thereof may be Fe—Al—Ce-based ferro alloys. Also, types of the Fe—Al—Ce-based ferro alloys may be varied according to the contents thereof.

The method may include casting the molten steel satisfying the composition. The casting is performed by a method of manufacturing typical bearing steel and the method thereof is not particularly limited. Both typically used ingot casting and continuous casting methods may be used therefor.

Hereinafter, examples of the present invention will be described in detail.

EXAMPLES

Bearing steels satisfying compositions of the following Table 1 were cast. The casting was performed by using a typical continuous casting method. Comparative Example represents typical bearing steel most widely used. With respect to Inventive Examples 1 through 3, a content of Mn was decreased and Ce was added in comparison to Comparative Example, but a lower amount of Mn was added in order to reduce segregation and an amount of MnS precipitates.

TABLE 1

| Category (wt %) | C | Si | Mn | P | S | Cr | Ce |
|---|---|---|---|---|---|---|---|
| Comparative Example | 0.99 | 0.25 | 0.34 | 0.009 | 0.008 | 1.47 | 0 |
| Inventive Example 1 | 1.01 | 0.24 | 0.15 | 0.012 | 0.007 | 1.50 | 0.087 |
| Inventive Example 2 | 1.01 | 0.23 | 0.18 | 0.013 | 0.004 | 1.45 | 0.131 |
| Inventive Example 3 | 1.00 | 0.24 | 0.24 | 0.010 | 0.006 | 1.48 | 0.256 |

Figure 2A:
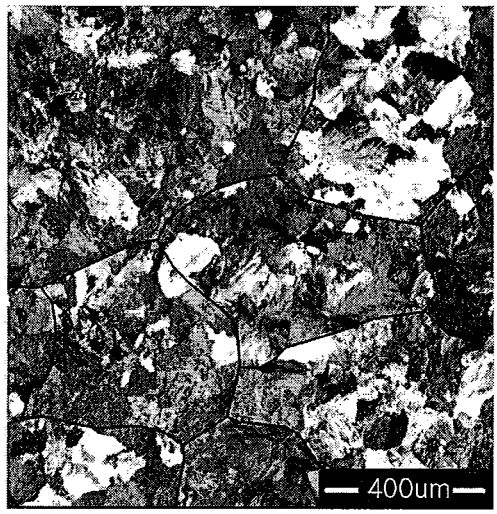
FIGS. 2(*a*) and 2(*b*) are micrographs illustrating equiaxed microstructures of segregation bands in a Comparative Example and Inventive Example 2, respectively.
Figure 2B:
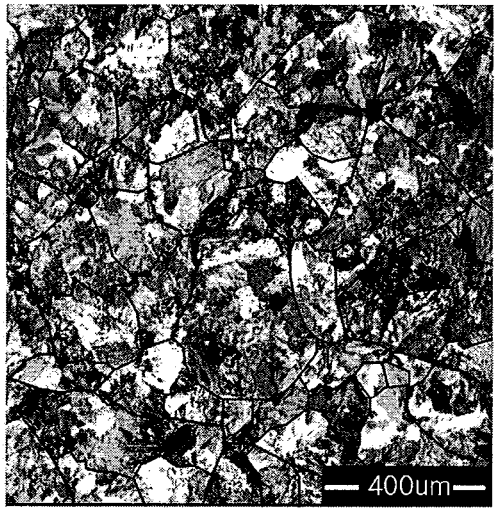

Equiaxed microstructures of segregation bands in casting materials of Comparative Example and Inventive Example 2 were observed and are respectively presented in FIGS. 2(*a*) and 2(*b*). Comparing FIG. 2(*a*) with FIG. 2(*b*), the equiaxed microstructure of Inventive Example 2 was much finer than that of the Comparative Example.

Figure 3A:
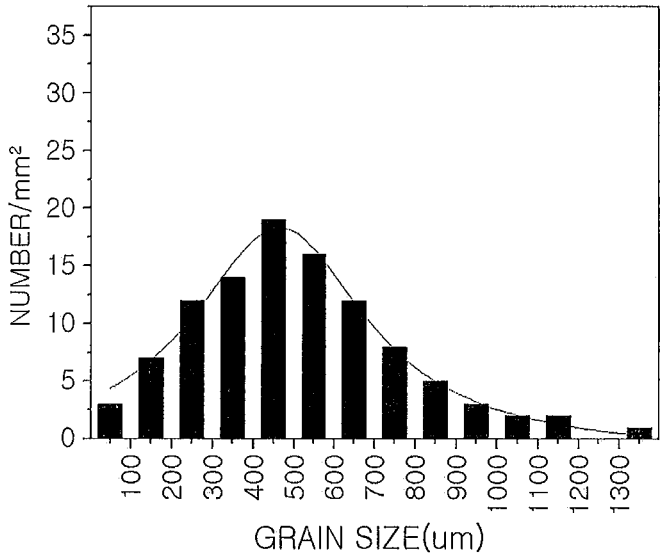
FIGS. 3(*a*) and 3(*b*) are graphs illustrating equiaxed grain size distributions of segregation bands in the Comparative Example and Inventive Example 2, respectively.
Figure 3B:
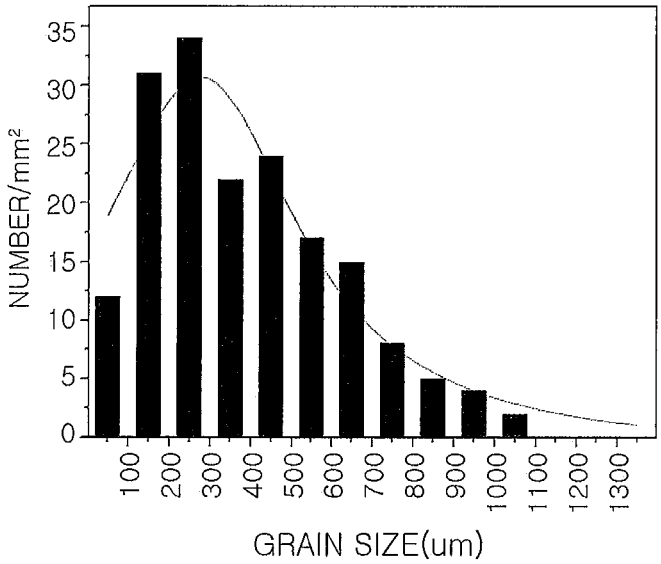

Equiaxed grain size distributions of the segregation bands in Comparative Example and Inventive Example 2 were observed and the results thereof are presented in FIGS. 3(*a*) and 3(*b*), respectively. With respect to the Comparative Example in FIG. 3(*a*), an average equiaxed grain diameter of a solidification structure was about 496 μm, but it may be confirmed that the average equiaxed grain diameter of Inventive Example 2 in FIG. 3(*b*) was much finer at about 325 μm.

Figure 4A:
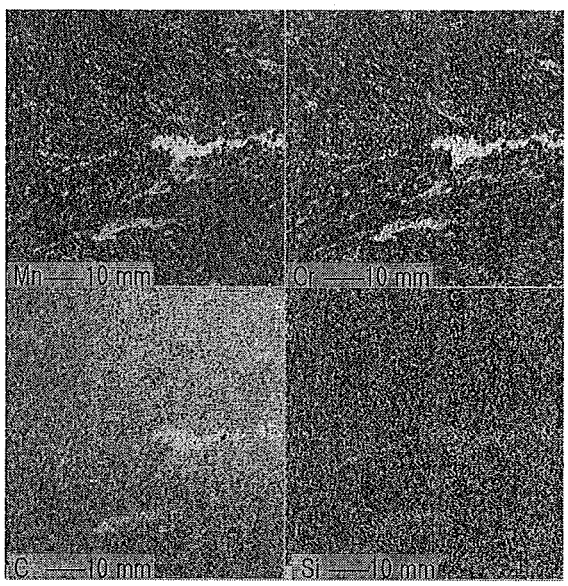
FIGS. 4(*a*) and 4(*b*) illustrate the results of electron probe X-ray micro analyses of segregation bands in the Comparative Example and Inventive Example 2, respectively.
Figure 4B:
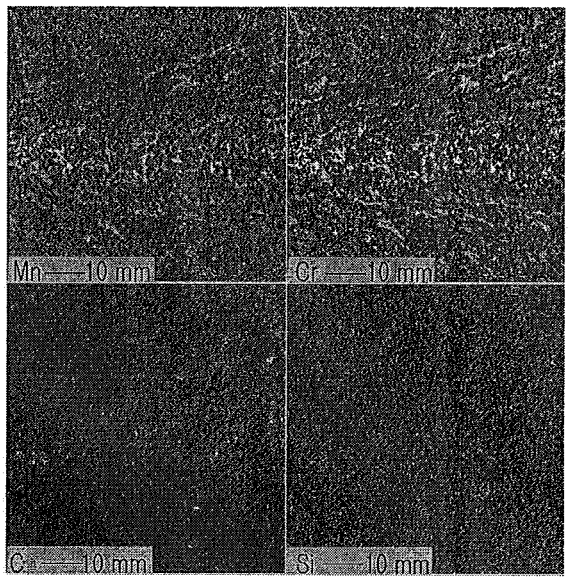

In order to confirm that the effect of refining equiaxed grains in the segregation band of the bearing steel casting material due to the addition of Ce eventually resulted in the reduction of segregation, electron probe X-ray micro analyses for investigating distribution of each alloying element in the Comparative Example and Inventive Example 2 were performed and the results thereof are presented in FIGS. 4(*a*) and 4(*b*). As illustrated in FIG. 4(*a*), it may be confirmed that segregations of Mn, Cr, and C were severe in Comparison Example, but it may be confirmed that segregations were considerably reduced in Inventive Example 2 of FIG. 4(*b*) in comparison to Comparison Example.

Figure 5:
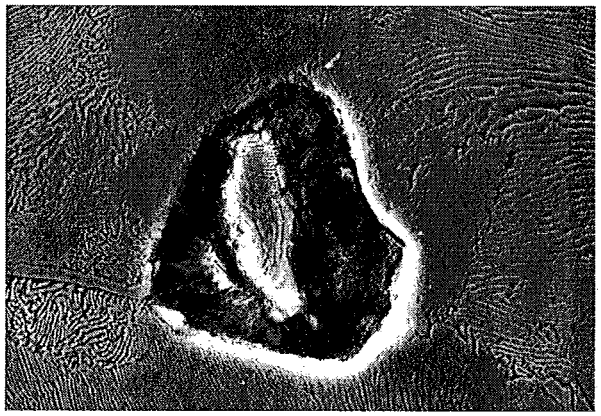
FIG. 5 is a micrograph of $CeO_2$ oxide at a triple junction of austenite grains in Inventive Example 2.

The effect of refining equiaxed grains and the reduction of segregation through the effect were due to the fact that Ce acted as an inoculant to promote the non-uniform nucleation of austenite grains by forming a compound in the molten steel, and $CeO_2$ at a triple junction of austenite gains was observed in Inventive Example 2 and is presented in FIG. 5.

Figure 6A:
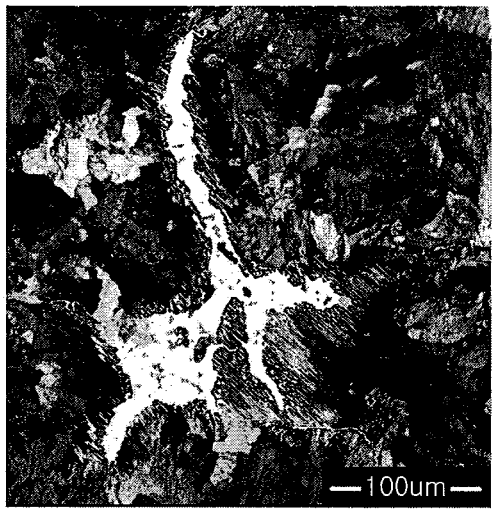
FIGS. 6(*a*) and 6(*b*) are micrographs illustrating microstructures of large carbides in segregation bands in Comparative Example and Inventive Example 2, respectively.
Figure 6B:
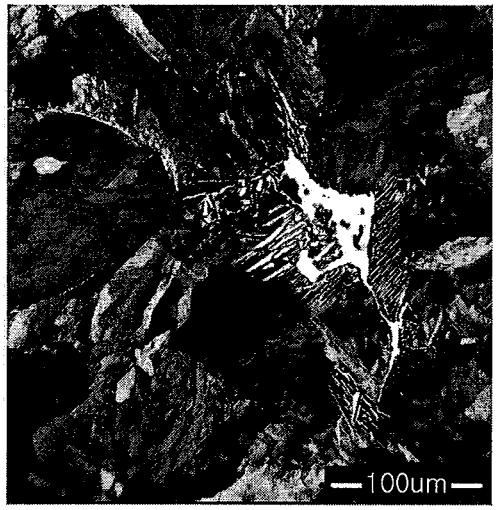

Also, the refinement of the equiaxed grains and the effect of reducing segregation due to the addition of Ce may significantly reduce the generation of large carbides in the segregation band of the casting material. FIGS. 6(*a*) and 6(*b*) are micrographs respectively illustrating microstructures of large carbides in the segregation bands in Comparative Example and Inventive Example 2. As illustrated in FIG. 6(*a*), large carbides having a diameter of about 125 μm were observed in the Comparative Example, whereas large carbides having a diameter of about 43 μm were observed in Inventive Example 2 presented in FIG. 6(*b*).

While the present invention has been shown and described in connection with the exemplary embodiments, it will be apparent to those skilled in the art that modifications and variations can be made without departing from the spirit and scope of the invention as defined by the appended claims.

The invention claimed is:

1. High-carbon chromium bearing steel comprising:

1.0 wt % to 1.2 wt % of carbon (C);

0.15 wt % to 0.24 wt % of silicon (Si);

0.05 wt % to 0.24 wt % of manganese (Mn);

0.025 wt % or less (excluding 0 wt %) of phosphorus (P);

0.025 wt % or less (excluding 0 wt %) of sulfur (S);

0.1 wt % to 1.6 wt % of chromium (Cr);

0.01 wt % to 0.3 wt % of cerium (Ce); and iron (Fe) as well as other unavoidable impurities as a remainder, and a Ce compound as an inoculant, the Ce compound being distributed at a number concentration ranging from $5/mm^2$ to $200/mm^2$.

2. The high-carbon chromium bearing steel of claim 1, wherein the Ce compound is one or more selected from the group consisting of Ce oxides, Ce nitrides, and Ce carbides.

3. The high-carbon chromium bearing steel of claim 1, wherein the Ce compound is one or more selected from the group consisting of $AlCeO_3$, $Ce_2O_3$, $Ce_2O_2S$, $Ce_2S_3$, CeS, and $CeO_2$.

4. The high-carbon chromium bearing steel of claim 1, wherein a lattice misfit of the Ce compound with a casting structure of the bearing steel is 15% or less.

5. The high-carbon chromium bearing steel of claim 1, wherein the Ce compound has a spherical shape and an average grain diameter of the Ce compound is 20 μm or less.

6. A method of manufacturing high-carbon chromium bearing steel according to claim 1 by casting after refining molten steel, the method comprising using a cerium (Ce) compound as an inoculant to manufacture the bearing steel.

7. The method of claim 6, wherein the compound containing Ce is one or more selected from the group consisting of Ce oxides, Ce nitrides, Ce carbides, and Fe—Al—Ce-based ferro alloys.

* * * * *